US006076216A

United States Patent [19]

Biryukov

[11] Patent Number: 6,076,216

[45] Date of Patent: Jun. 20, 2000

[54] APPARATUS FOR DUST REMOVAL FROM SURFACES

[75] Inventor: Sergey A. Biryukov, Beer-Sheba, Israel

[73] Assignee: Ben-Gurion University of Negev, Beer-Shera, Israel

[21] Appl. No.: 08/905,512

[22] Filed: Aug. 4, 1997

[51] Int. Cl.[7] ..... A47L 13/40

[52] U.S. Cl. ..... 15/1.51; 134/1

[58] Field of Search ..... 15/1.51, 1.52; 134/1; 209/127.1, 128, 129, 130; 361/222, 233, 230, 225

[56] References Cited

U.S. PATENT DOCUMENTS

| | | | |
|---|---|---|---|
| 3,536,528 | 10/1970 | De Geest | 134/1 |
| 3,872,361 | 3/1975 | Masuda | 361/233 |
| 3,970,905 | 7/1976 | Itoh et al. | 15/1.51 |
| 4,517,078 | 5/1985 | Inculet et al. | 209/127.3 |
| 4,744,833 | 5/1988 | Cooper et al. | 134/1 |
| 5,030,999 | 7/1991 | Lindblad et al. | 15/1.51 |
| 5,634,230 | 6/1997 | Mauer | 15/1.51 |
| 5,840,263 | 11/1998 | Shinoda et al. | 423/243.01 |

*Primary Examiner*—Robert J. Warden, Sr.
*Assistant Examiner*—Kaj K. Olsen
*Attorney, Agent, or Firm*—Fulbright & Jaworski

[57] ABSTRACT

The present invention relates to a method and apparatus for cleaning surfaces of dust by the use of an alternating electrical field with a low power consumption. The amplitude of the electrical field is between 1,000 and 30,000 V/cm and its frequency is from 10 to 1000 Hz.

1 Claim, 8 Drawing Sheets

APPARATUS FOR DUST REMOVAL FROM SURFACES

FIELD OF THE INVENTION

The invention relates to a method and apparatus for cleaning surfaces from dust, particularly for cleaning large surfaces, which must be kept free from dust accumulation, such as, for example, light-collecting surfaces of solar power generators and other specular or transparent surfaces, and maintaining said surfaces clean from dust, with limited power consumption.

BACKGROUND OF THE INVENTION

The problem of cleaning from dust and maintaining free from dust surfaces, in particular large surfaces, is known in the art and several attempts have been made to solve it. The problem is felt in particular in the case of apparatus which has large surfaces that must be kept free from dust in order that their reflecting power be not diminished, such as light-collecting surfaces of solar power generators and the like.

Purely mechanical means for treating surfaces, by air jet or by mechanical cleaning devices, are inefficient and expensive, as they require a considerable amount of energy and their effect is not permanent, so that their application must be continuously renewed. Some attempts have been made to increase the efficiency of dust-removing apparatus by electrical means.

For instance, Russian patent SU 1640666 discloses a method of dust removal from dielectric films which comprises charging the film, passing it through a high voltage DC-charger, cleaning it by air jets providing both blasting and suction, and neutralizing it. This method, however, involves a very high energy consumption.

U.S. Pat. No. 4,751,759 discloses a surface-cleaning appliance which has a nozzle having a narrow, slanted, straight slot blowing a flat laminar air jet obliquely onto the surface being cleaned. An ionizer is connected to the air-blowing jet, so that ions are produced from neutralizing electrically loaded dust particles. Once again, this is a high energy consumption device.

Russian patent SU 698494 describes a method of cleaning the surface of laser mirrors, to remove dust particles, by moving above the surface a film, particularly a fluoropolymer film, carrying a static electrical charge. However, fine dust cannot be cleaned by this manner, and only relatively large particles are removed by attraction to the cleaning film, and the cleaning film must be periodically cleaned of dust.

Clearly, none of the prior art methods and devices satisfactorily solves the problem of cleaning large surfaces and keeping them clean, without high consumption of energy.

It is a purpose of this invention to provide such a method and apparatus which permit to remove from surfaces dust particles.

It is another purpose of this invention to provide a method and apparatus that effectively clean surfaces from dust with a limited energy consumption.

It is a further object of the invention to provide such a method and apparatus that permit to clean large surfaces.

It is a still further purpose of this invention to provide such a method and apparatus which do not comprise components that have to be periodically cleaned.

It is a still further purpose of this invention to provide such a method and apparatus which are based on electrical phenomena only.

Other purposes and advantages of this invention will appear as the description proceeds.

SUMMARY OF THE INVENTION

The method according to the invention is characterized in that the surface to be cleaned is subjected to the action of an alternating electrical field.

The invention is based on the discovery by the inventor of a physical phenomenon which manifests itself in the repulsion of dielectric and other particles from the high gradient regions of alternating electrical fields. The inventor has found out that, for fixed parameters of the electric field, this repulsion results in the rebound, from surfaces to which they adhere, of particles in a broad range of sizes, from several microns to hundred micron and larger, and this fact provides the basis for the application of this phenomenon to the cleaning of surfaces. The preferred range of parameters of the electrical field is as follows:

the amplitude of the electrical field is between 1,000 and 30,000 V/cm and preferably between 5,000 and 20,000 V/cm. Its frequency is from 10 to 1000 Hz and preferably from 50 to 500 Hz.

The electrical field is preferably created by providing an open circuit in which an alternating voltage is generated, so that the energy consumption is almost negligible for most applications. Consequently, the apparatus according to the invention comprises an electrode or a plurality of electrodes placed in the vicinity of the surface to be cleaned, as will be better explained hereinafter, and a source of alternating voltage, said electrode or electrodes and said voltage source being electrically connected in an open circuit.

In various embodiments of the invention, as will be better explained, the electrode or electrodes may be stationary with respect to the surface to be cleaned, or there may be a relative motion between said electrodes and said surface. The connection between the electrodes and the source of alternating voltage may be permanent, or may be periodically open and closed to feed to the electrodes the alternating voltage.

The shape of an electrode or electrodes, that create high gradient of alternating electric field near the surface to be cleaned, can vary widely, depending mostly on the shape of the surface. In the cases of flat or cylindrical surfaces, rectilinear electrodes parallel to the surface are practical in most cases. The examples of use of some other shapes will be given later.

The electrical field produced by a rectilinear electrode is effective on an area of the surface to be cleaned (hereinafter also called "working area") that is as long as the electrode and has a width in the order of magnitude that depends on the amplitude and the frequency of the field, but, if these latter are within the aforesaid preferred limits, is in the order of one centimeter. Therefore, to clean wider areas a sufficiently wide working area of the electrical field must be produced, and this can be achieved either by using a sufficiently high number of electrodes, sufficiently close to one another and concurrently or successively activated and deactivated, each to produce and cease to produce an electrical field, or by producing a relative motion between the surface to be cleaned and an electrical field in such a way that said field will act successively on different areas of the surface to be cleaned, e.g. by moving said surface with respect to one or more electrodes or vice versa.

When the electrical field acts successively on different areas of the surface to be cleaned, because there is a relative motion between said field and said surface, or because a number of electrodes are successively activated and deactivated, or for any other reason, each such area is subjected to the action of the electrical field for discrete periods of time, which can be called "active periods", separated by inactive intervals during which it is not so subjected. In these cases, the active periods must have a sufficient duration for the cleaning action to be effective, said duration being preferably from 0.1 to 100 sec, and more preferably from 1 to 10 sec.

In the apparatus according to the invention, the electrodes may be located above or under the surface to be cleaned, preferably at a distance not exceeding 4 to 5 mm. They can also be enclosed in a body, a surface of which is to be cleaned, at a depth not larger than 1–2 mm under said surface. A combination of these locations of the electrodes is also possible, according to the invention.

The method according to the invention, when carried out at atmospheric pressure, permits to remove dust, the particles of which have sizes within a broad range, e.g. from several microns to about one millimeter.

BRIEF DESCRIPTION OF THE DRAWINGS

In the drawings:

FIG. 8 schematically illustrates an embodiment with a circular electrode, coaxial to the surface of a glass cylinder to be kept clean from dust;

FIG. 9 schematically illustrates an embodiment with a spiral electrode, the spiral being coaxial and equidistant relative to the surface of a glass cylinder to be cleaned; and FIG. 10 schematically illustrates an embodiment which involves a stationary surface of glass-coated paraboloidal reflector and a plurality of stationary coaxial circular electrodes on its inner surface, which is analogous to the cases, illustrated by FIG. 3.

DETAILED DESCRIPTION OF PREFERRED EMBODIMENTS

Figure 1:
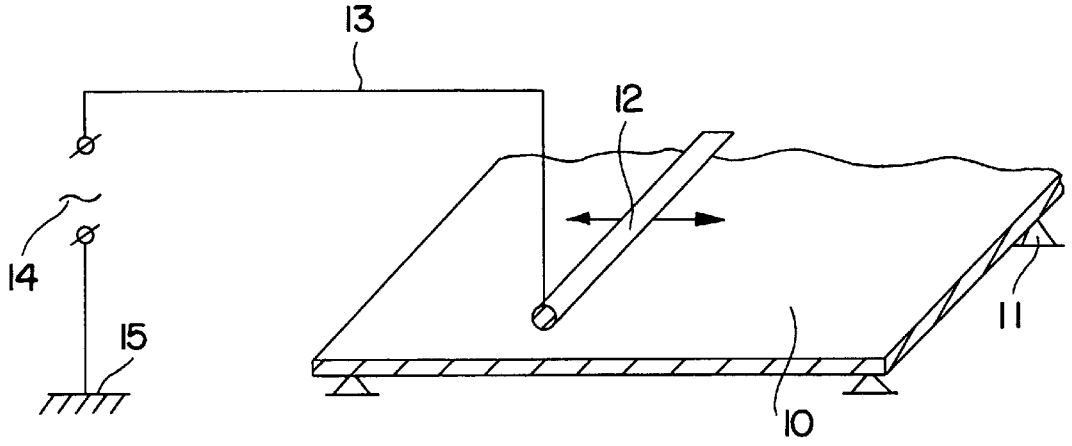
FIG. 1 illustrates an embodiment of the invention, involving a moving electrode and a stationary surface to be cleaned.

In FIG. 1, numeral 10 schematically indicates a surface to be cleaned, which is stationary and supported on supports 11. A cylindrical electrode 12 is connected by means of a conductor 13 to an alternating voltage generator 14, which is grounded as at 15. The electrode 12 is actuated to move back and forth in the direction of the arrows over the surface 10. Surfaces that can be conveniently cleaned by this method are, for example flat or parabolic etc. glass-coated mirrors of solar collectors; windows; and the like. In this embodiment, the electrode 12 is a metallic wire having a diameter of about 300$\mu$ and a length equal to the width of the sheet. The intensity of the electric field and its frequency are in the aforesaid preferred ranges, and may be, e.g., 20,000 V/cm and 100 Hz respectively. The distance of the electrode from the surface 20 is about 2 mm.

Figure 2A:
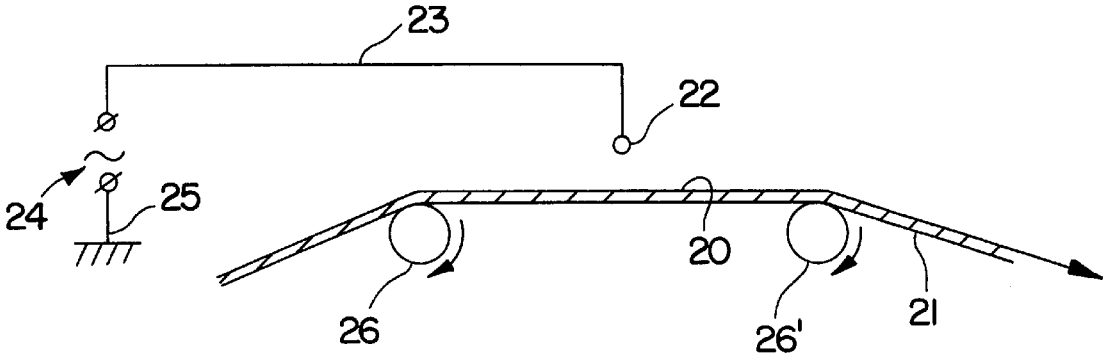
FIGS. 2*a* and 2*b* schematically illustrate embodiments involving a stationary electrode and a movable surface to be cleaned.
Figure 2B:
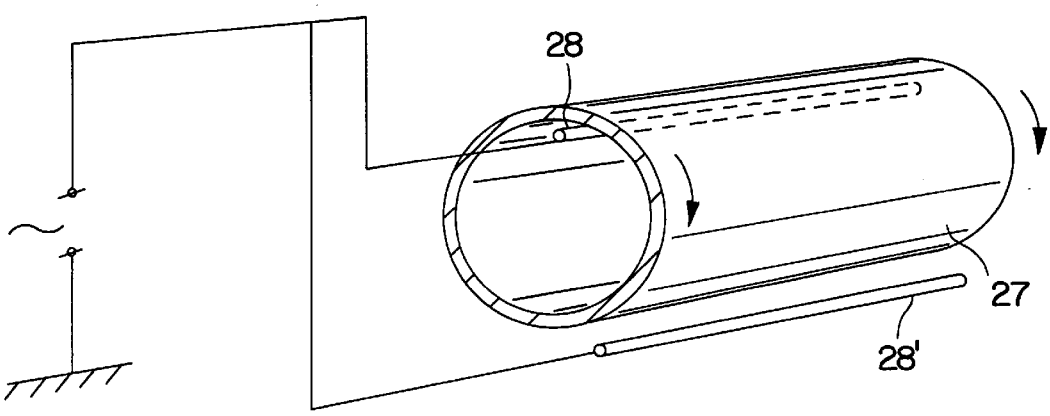

FIGS. 2*a* and 2*b* illustrate embodiments in which a relative motion is produced between the electrical field and the surface to be cleaned by keeping the electrode stationary and moving the surface to be with respect to it. In FIG. 2*a*, the electrode is indicated at 22. It is connected by conductor 23 to an electric field generator 24, which is grounded at 25. The surface to be cleaned is indicated at 20, and is part of a flexible sheet 21 which travels over guides such as cylinders 26 and 26', and is drawn in motion by means not shown. Such a sheet may be, e.g., any kind of dielectric film, e.g. made of paper, rubber, plastics, etc. In this embodiment, the electrode 22 is a metallic wire having a diameter of about 200$\mu$ and a length equal to the width of the sheet. The intensity of the electric field and its frequency are in the aforesaid preferred ranges, and may be, e.g., 15,000 V/cm and 400 Hz respectively. The distance of the, electrode from the surface 20 is 2 mm. The speed of the sheet motion is from 0.5 to 2 cm/sec. In this embodiment, the cleaning electrode is permanently fed with an alternating potential during the movement of the film.

In the embodiment of FIG. 2*b*, a thick-walled cylinder 27 rotates about its axis and both its inner and its outer surface are kept clean of dust by the electric fields produced by inner electrode 28 and outer electrode 28' respectively. The distance of each electrode from the adjacent surface of the cylinder is about 1–2 mm. The intensity of the field and its frequency are the same as in the embodiment of FIG. 2*a*. The cylinder 27 may be several meters long and have practically any diameter, starting from about 1 cm and larger; and may be made of any dielectric material, e.g. glass. The speed of rotation thereof is such as to produce a linear velocity of the points of the cylinder surfaces with respect to the corresponding electrodes of 0.5 to 2 cm/sec, thereby causing the cleaning action of the electric field on each surface point to be correspondingly periodical. In this embodiment, the cleaning electrode can be permanently fed with an alternating potential, as in the embodiment of FIG. 2*a*, or be fed periodically, e.g., only for 1–2 periods of the cylinder rotation out of every 100 periods.

Figure 3:
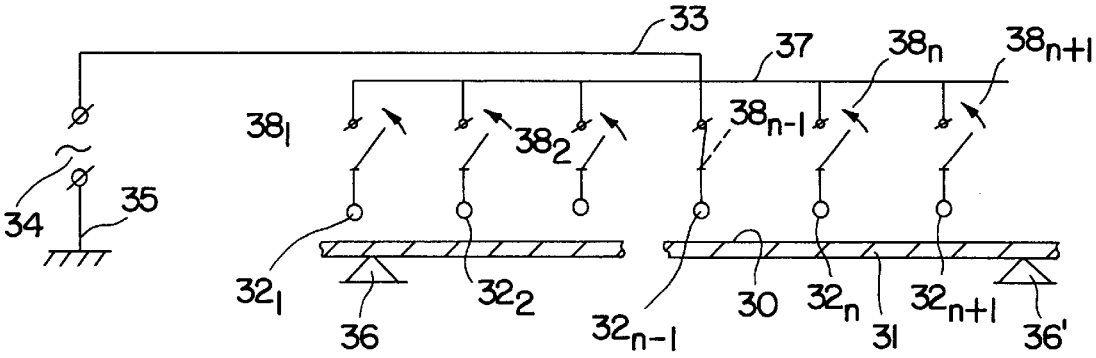
FIGS. 3 and 4 schematically illustrate embodiments which involve a stationary surface to be cleaned and a plurality of stationary electrodes.

FIG. 3 shows an embodiment which gives an example of surface cleaning by means of an alternating electric field moving along the surface without mechanical movement of electrode. In the embodiment chosen for illustration, a flat surface 30 to be cleaned is part of a sheet-like body 31 supported at 36 and 36'. For reasons of illustration, the body 31 is shown as broken. At a distance of 2–3 mm are positioned a plurality of electrodes 32 placed at a distance of about 10 mm from one another, which are connected in parallel through a conductor 37 and all together through a conductor 33 to an alternating electric field generator 34, grounded at 35.

Figure 6:
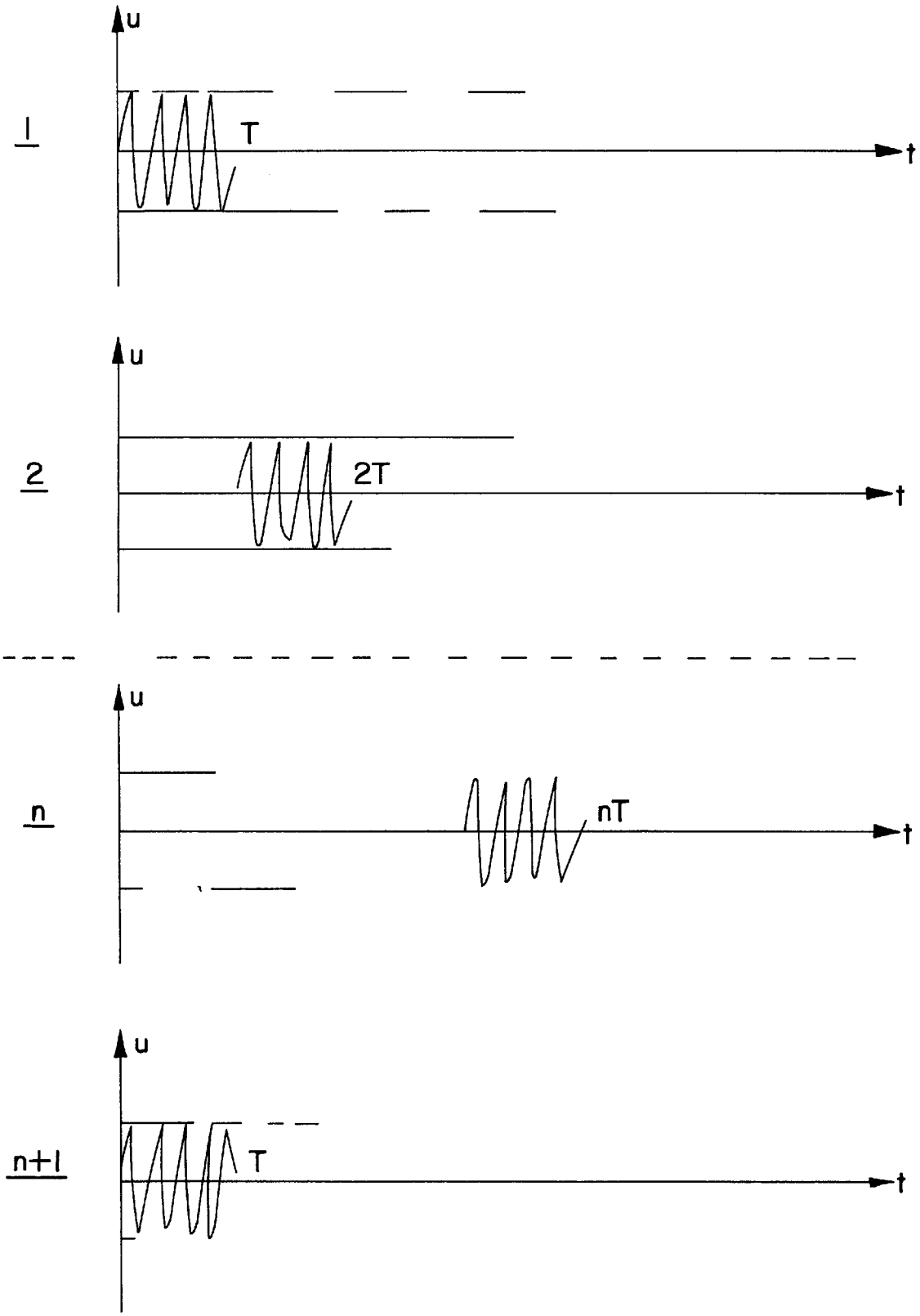
FIG. 6 illustrates the voltage/time relationship in an electrode apparatus such as that in FIGS. 3 to 5.

The operation of this embodiment is further illustrated in FIG. 6, which shows the shifting of the electric field between the various electrodes. The electrodes are connected to the electric field generator through switches schematically indicated at 38, a switch corresponding to each electrode. The time during which each switch 38 is closed, to feed the electric field to the corresponding electrode, is indicated in FIG. 6 by T. The switches of the electrodes having numbers (1, 1+n, 1+2n, etc.), then (2, 2+n, 2+2n. etc.), (3, 3+n, 3+2n, etc.), are closed and opened together. Now, when switch $\mathbf{38}_1$ is closed, electrode $\mathbf{32}_1$, is connected to the voltage source and generates the electric field for a period T, as shown at numeral 1 in FIG. 6. The electric field, in this embodiment, has an intensity and a frequency in the aforesaid preferred ranges, e.g., 20,000 V/cm and 400 Hz respectively, and the time T is 1÷5 sec. Now, after said time T, switch $\mathbf{38}_1$ is open and switch $\mathbf{38}_2$ is closed, so that $\mathbf{38}_1$, ceases to be connected to the voltage source and to generate the electric field, while electrode $\mathbf{38}_2$ is connected to the voltage source and generates the electric field for a time T, viz. it begins to do so at a time T and stops doing so at a time 2T, as shown at numeral 2 in FIG. 6. Each of the following switches 38 is closed and successively opened and stays open for a time T. When the nth switch has been opened and closed, and the electrode 32*n* has received and then stopped receiving the alternating voltage, a time nT has elapsed, as shown at n in FIG. 6. The (n+1)th, (2n+1)th, etc. switches are now closed together with the 1st one, and the corresponding electrodes become connected to the voltage source and begin to generate the electric field, and the cycle is repeated for a period equal to nT, and so on, for each successive group of n electrodes and switches. In this way each switch, starting from the first and successively, is closed, and left closed for T seconds, and then opened while the next one is closed, and so on. Therefore T seconds is also the duration of the active periods through which each point of the surface is subjected to the action of the electrical field with repetition time nT.

Figure 4:
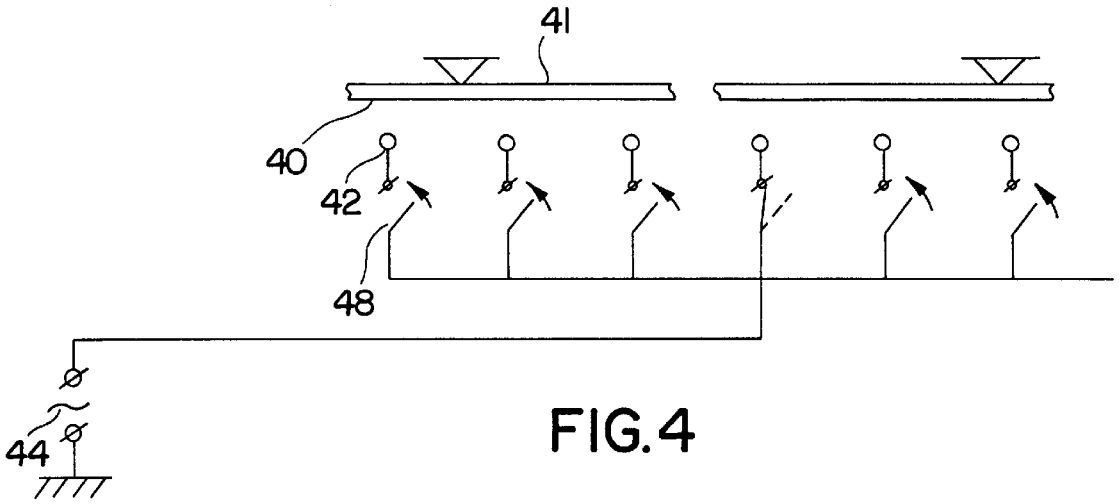

FIG. 4 shows an embodiment which is identical to that of FIG. 3, except that the electrodes 42 are placed below the surface 40 of body 41, the surface 40 being the surface to be cleaned. The electrodes are successively connected to the grounded alternating voltage generator 44 by means of switches 48, exactly as in the embodiment of FIG. 3.

Figure 5:
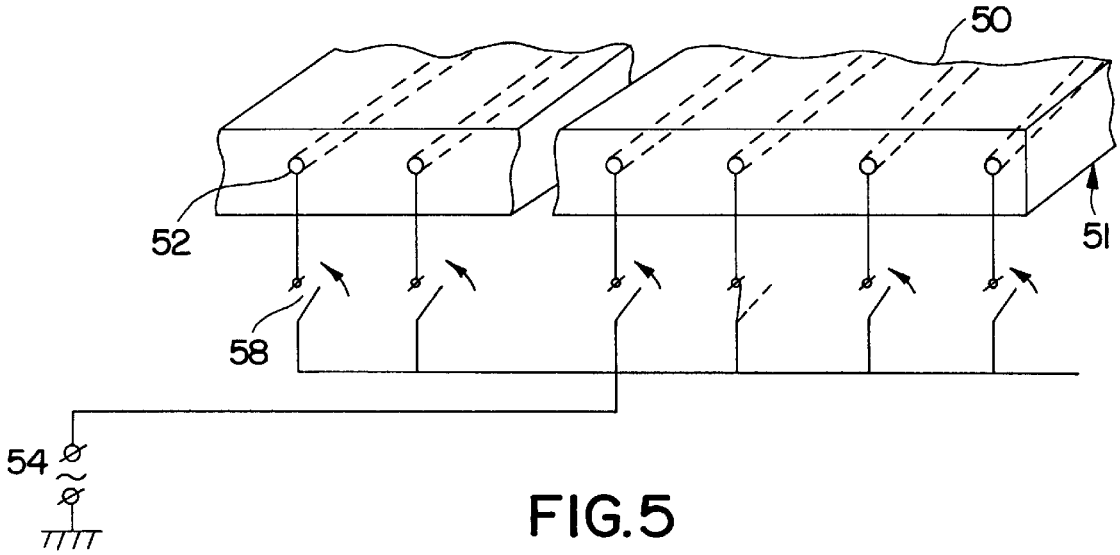
FIG. 5 schematically illustrates an embodiment involving a plurality of electrodes embedded in a body a surface of which is to be cleaned.

The embodiment of FIG. 5 is not different from those of FIGS. 3 and 4, except that the electrodes 52, which are connected through switches 58 to alternating voltage generator 54, are embedded in the body 51, a surface 50 of which is to be cleaned, and are placed at a distance of about 0.1 mm below that surface.

Figure 7:
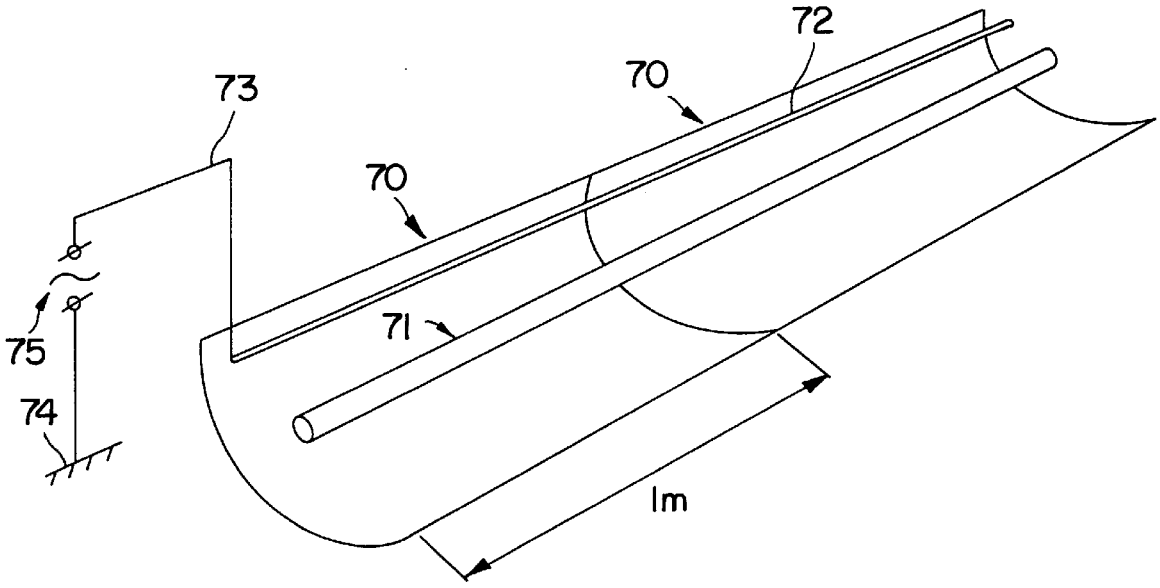
FIG. 7 illustrates a particular application of the invention.

FIG. 7 illustrates a typical application of the invention. Numeral 70 indicates a parabolic trough mirror of a solar concentrator. Numeral 71 indicates a cylindrical glass receiver placed in the focus of mirror 70. A 300–500$\mu$, thick wire electrode 72 is placed at a distance of 2 mm from the surface of said mirror and is fed through conductor 73, grounded at 74, from an alternating electric field generator 75. The electric field has an intensity of 20,000 V/cm and a frequency of 200 Hz. The said electrode is moved parallel to the mirror surface, by any suitable mechanical means, not illustrated as it may be conventional, with a speed of about 1 cm/sec.

Figure 8:
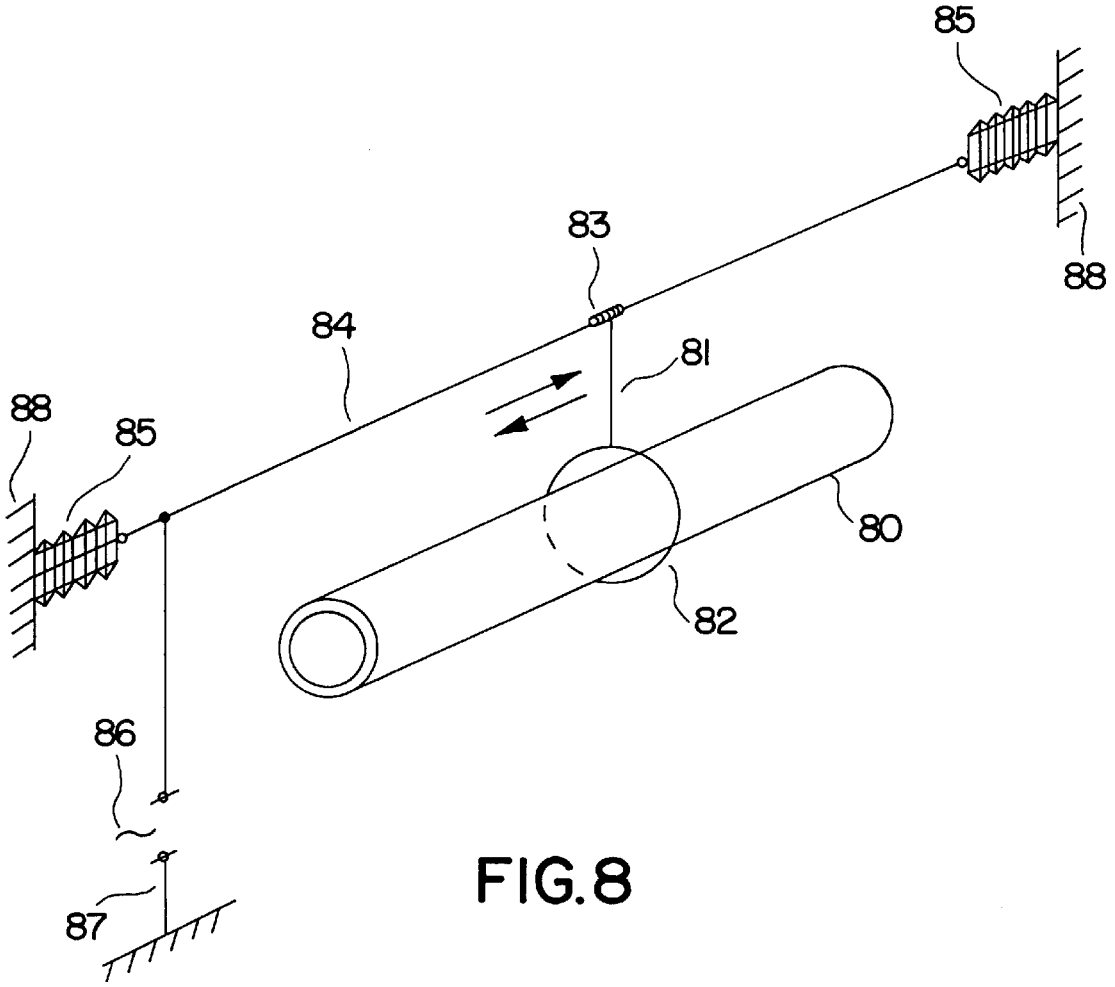
FIGS. 8–10 schematically illustrate embodiments of the invention comprising non-rectilinear electrode shapes, and specifically.

FIG. 8 schematically illustrates an application of a circular electrode 82 for cleaning the outer surface of a stationary cylinder 80 by moving the electrode parallel to the cylinder axis. The electrode 82 is connected to alternating electric field generator 86, grounded at 87, by means of conductor 81, moving contact 83 and stationary conductor 84, electrically isolated from supports 88 by means of insulators 85. The electrode 82, in this case, is a thin metal wire about 300 micron thick in some rigid frame, made of dielectric material. The parameters of the electric field are the same as in the embodiment of FIG. 2*b*. The frame of electrode 82 must be of such a diameter as to provide a distance of about 2 mm between the electrode 82 and the cylinder surface 80 to be cleaned. The cylinder can have a diameter from about 1 cm to about 50 cm, and be up to several meters long. The speed of the electrode's longitudinal movement should be about 1 cm/sec.

Figure 9:
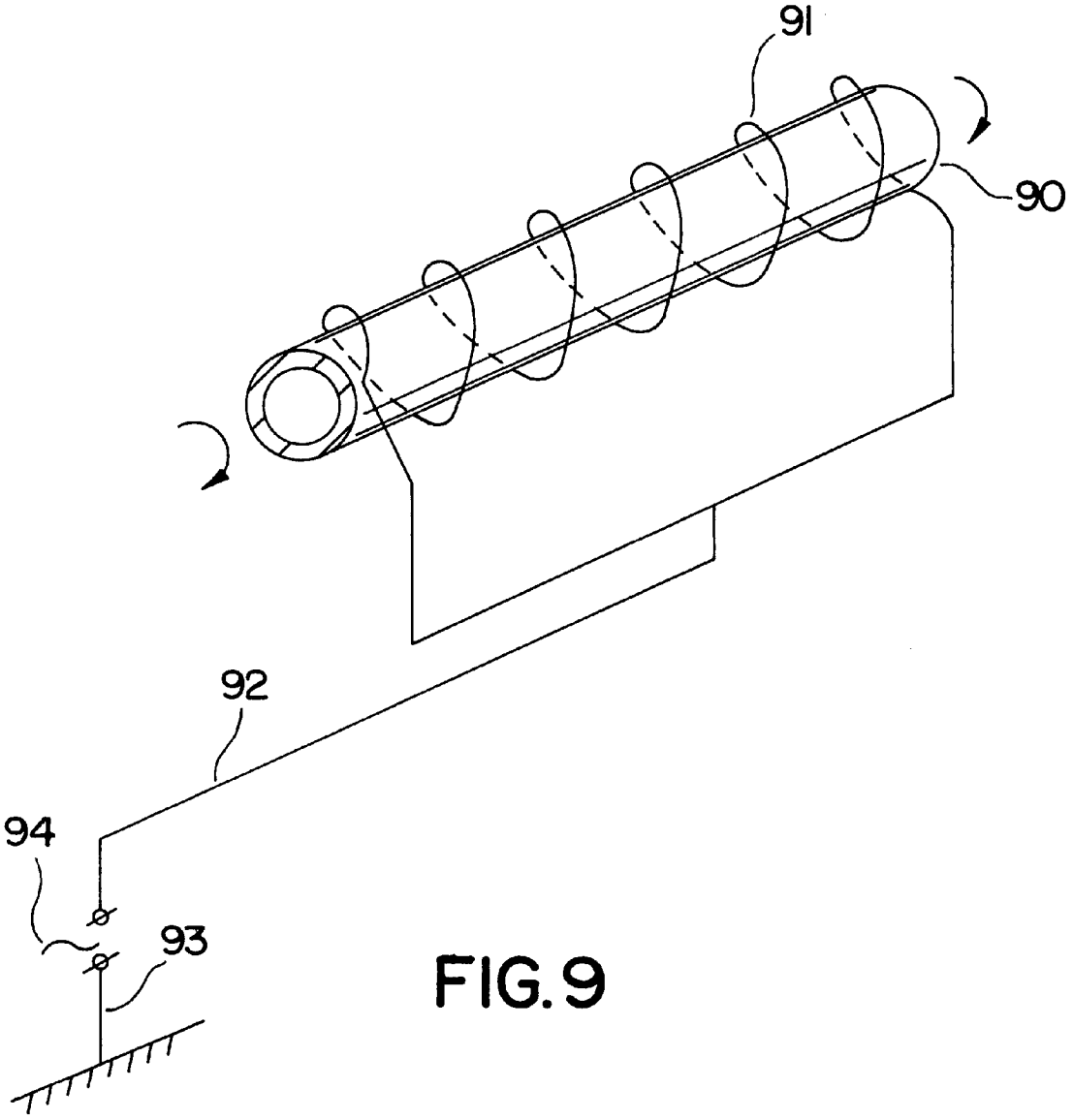

FIG. 9 schematically illustrates the cleaning of the outer surface of a rotating cylinder 90 by the high gradient of an alternating electric field created by generator 94, grounded at 93, and connected by conductor 92 with a stationary spiral electrode 91, coaxial to the cylinder. The electrode is 300 micron thick and is supplied with a spiral-shaped dielectric supporting frame, as in the embodiment of FIG. 8. The radius of the electrode's frame should be 2 mm larger than the radius of the cylinder, and the distance between successive spiral coils should exceed 1 cm.

The parameters of the electric field are the same as in the embodiment of FIG. 2*b*. The speed of rotation and conditions of the feeding of the electrode with the electric field are also the same. This device is useful for keeping cylindrical bodies, with diameters between about 2 and 30 cm and lengths from about between 10 cm and 1 meter, free of dust.

Figure 10:
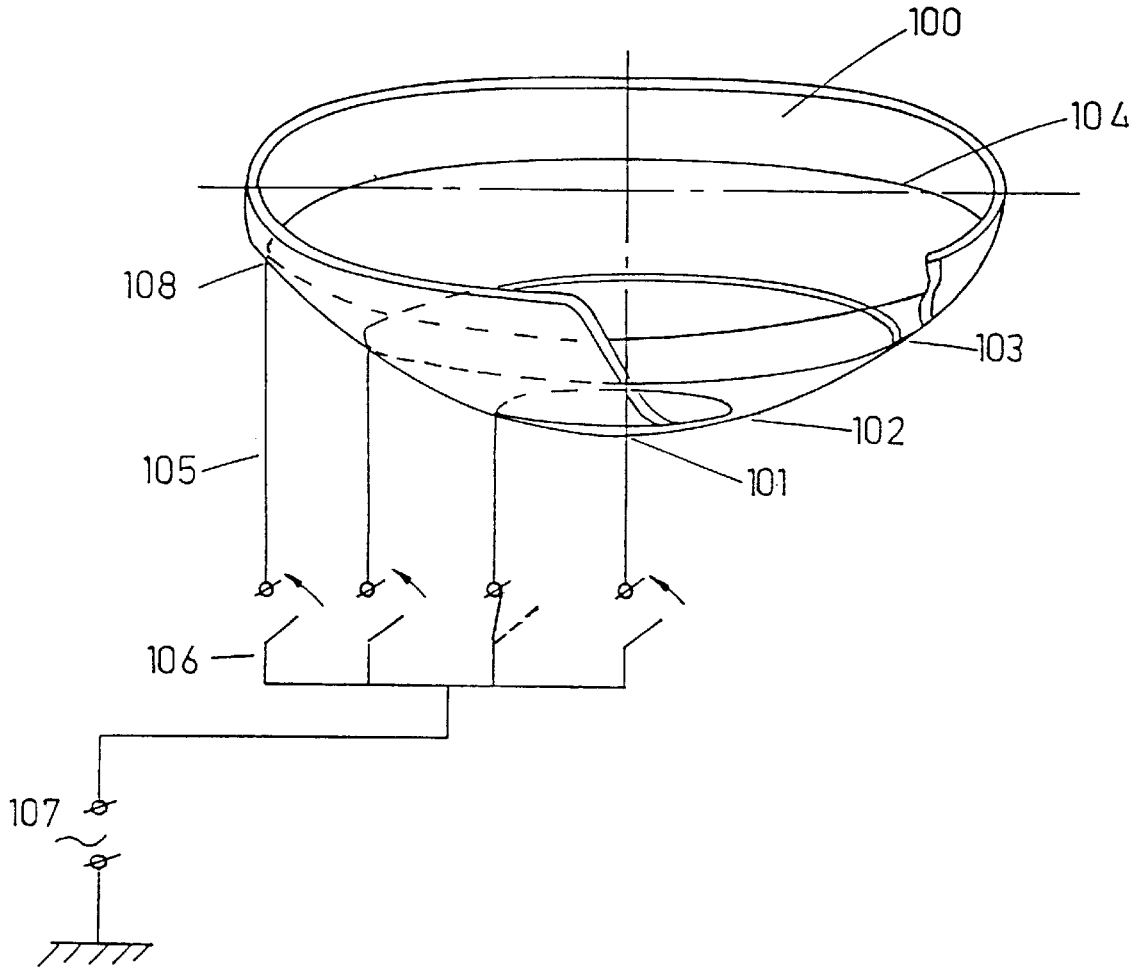

FIG. 10 schematically illustrates an embodiment which involves a stationary, dielectric paraboloidal surface 100 and a plurality of stationary electrodes 101–104 on its inner surface. For reasons of illustration, the paraboloidal body is shown as partly broken off. The central electrode 101 is positioned on the top of the paraboloid and is the end of a needle-shaped wire having a diameter of about 200 microns. All other electrodes (102, 103, 104) are coaxial wires, having a diameter of about 200 microns. They must be approximately equidistantly attached directly to the paraboloidal surface, with a distance of about 5–6 mm between adjacent ones.

Electrodes 101–104 are connected to generator 107 through switches 106, and are consequently and repeatedly fed with an alternating electric field in the order: 101, 102, 103, 104, 101, 102, 103, 104, 101, . . . etc., as was explained in describing the embodiments of FIGS. 3 and 6. In some practical applications, e.g., in the case of glass-coated surface of a paraboloidal reflector, the conductors 105, supplying the electrodes 101–104 with the electric field, must be isolated from the conducting mirror layer by means of insulators 108. All the parameters of the alternating electric field are also the same as in the previously described embodiments.

This embodiment is applicable to the case of paraboloidal shapes starting from almost flat (including the particular case of a flat disk) shapes up to shapes in which the depth of the paraboloid is approximately equal to its aperture. With this limitation, the embodiment can be applied to paraboloids of almost any size (from apertures of 2–3 cm to several meters) by using a sufficiently large number of electrodes.

While a number of embodiments have been described by way of illustration, it will be apparent that the invention may be carried out with many variations, modifications and adaptations by persons skilled in the art, without departing from its spirit or exceeding the scope of the claims.

I claim:

1. Apparatus for electrically cleaning a surface of adhered dust, characterized in that it comprises an electrode placed in the vicinity of the surface to be cleaned, said electrode being of a substantially circular shaped coaxial to and having a larger diameter than said surface, means are provided for displacing said electrode parallel to the axis of said surface, and a source of alternating voltage having a ground and a voltage source, said electrode and voltage source being electrically connectable in an open circuit and electrically cleaning the surface of adhered dust solely by the alternating voltage providing an electrical repulsion of the dust.

* * * * *